US005341946A

United States Patent [19]

Vailliencourt et al.

[11] Patent Number: 5,341,946

[45] Date of Patent: Aug. 30, 1994

[54] HOT FILL PLASTIC CONTAINER HAVING REINFORCED PRESSURE ABSORPTION PANELS

[75] Inventors: Dwayne G. Vailliencourt, Manchester, Mich.; Theodore F. Eberle, Jr., Kapellen, Belgium

[73] Assignee: Hoover Universal, Inc., Plymouth, Mich.

[21] Appl. No.: 39,595

[22] Filed: Mar. 26, 1993

[51] Int. Cl.[5] ..... B65D 1/02; B65D 1/42; B65D 23/08

[52] U.S. Cl. ..... 215/1 C; 40/310; 220/609; 220/672; 220/675

[58] Field of Search ..... 215/1 C, 100 A; 40/310; 220/606, 609, 672, 675

[56] References Cited

U.S. PATENT DOCUMENTS

| | | | |
|---|---|---|---|
| D. 313,750 | 1/1991 | York et al. | D9/394 |
| 4,497,855 | 2/1985 | Agrawal et al. | 215/1 C X |
| 4,749,092 | 6/1988 | Sugiura et al. | 215/1 C |
| 4,805,788 | 2/1989 | Akiho et al. | 215/1 C |
| 4,863,046 | 9/1989 | Collette et al. | 215/1 C |
| 5,054,632 | 10/1991 | Alberghini et al. | 215/1 C |
| 5,064,081 | 11/1991 | Hayashi et al. | 215/1 C |
| 5,067,622 | 11/1991 | Garver et al. | 215/1 C |
| 5,092,475 | 3/1992 | Krishnakumar et al. | 215/1 C |
| 5,178,289 | 1/1993 | Krishnakumar et al. | 215/1 C |
| 5,178,290 | 1/1993 | Ota et al. | 215/1 C |
| 5,199,588 | 4/1993 | Hayashi | 220/666 X |
| 5,217,737 | 6/1993 | Gygax et al. | 220/609 X |
| 5,222,615 | 6/1993 | Ota et al. | 215/1 C |

FOREIGN PATENT DOCUMENTS

| | | | |
|---|---|---|---|
| 2000959 | 4/1991 | Canada | 215/1 C |

*Primary Examiner*—Sue A. Weaver

*Attorney, Agent, or Firm*—Leonard J. Kalinowski; E. L. Levine; Joseph E. Root, III

[57] ABSTRACT

A hot-fill plastic container includes a plurality of elongated vertically oriented vacuum absorption panels in its sidewall, each of the panels having an outwardly projecting center portion which is divided into upper and lower panel portions by a transversely extending rib, the panel portions being connected to the top and bottom of the vacuum panel by outwardly curved connecting portions which reverse the curvature of the vacuum panel adjacent to its upper and lower edges to reinforce the vacuum panels to prevent the sidewall from taking a permanent set which deflected inwardly, the corners of the vacuum panel having a relatively large radius of curvature to provide stiffening of the panels at their corners. Annular reinforcement ribs located in the sidewall above and below the vacuum panels provide additional support for the upper and lower edges of the vacuum panels.

29 Claims, 4 Drawing Sheets

HOT FILL PLASTIC CONTAINER HAVING REINFORCED PRESSURE ABSORPTION PANELS

CROSS REFERENCE TO RELATED APPLICATION

This application is related to U.S. Pat. application Ser. No. 08/016,635, of Dwayne G. Vailliencourt, filed Feb. 12, 1993, which is assigned to Hoover Universal, Inc. and which is incorporated herein by reference.

BACKGROUND OF THE INVENTION

This invention relates to hot-fill plastic or polyester containers, and more particularly to an improved sidewall construction for such containers.

In the past, most plastic or polyester containers were used to contain liquids that are initially dispensed at room temperature or chilled. However, in recent years, there has been a significant increase in the demand for polyester containers for packaging "hot fill" beverages. "Hot-fill" applications impose additional mechanical stresses on the container structure which cause the container to be less resistant to deformation when the container is being handled or if it is dropped. The thin sidewalls of conventional polyester containers deform or collapse at hot fill temperatures. Moreover, the rigidity of the container decreases immediately after the "hot-fill" liquid is introduced into the container, making the container more susceptible to failure due to mechanical stresses. As the hot-filled liquid cools, it shrinks in volume which has the effect of lowering the pressure or producing a "hot-fill" vacuum in the container. The container must be able to sustain such internal pressure changes while maintaining its configuration.

Various methods have been devised to counter thermal instabilities. One method broadly involves heat treating the polyester to induce molecular changes which will result in a container exhibiting thermal stability. Other methods involve forming the polyester structure into a structural configuration which can maintain stability during hot fill. Thus, the hot-fill containers being produced have a generally cylindrical main body which is provided with a plurality of elongated vertically oriented panels. These panels, which are commonly referred to as pressure or vacuum absorption panels, are designed to flex inwardly after the container has been filled with a hot liquid to accommodate the inevitable volume shrinkage of the liquid in the container as the liquid cools. However, the inward flexing of the panels caused by the hot fill vacuum creates high stress points at the top and bottom edges of the pressure panels, and especially at the upper and lower corners of the panels. These stress points weaken the portions of the sidewall near the edges of the panels, allowing the sidewall to collapse inwardly during handling of the container or when containers are stacked together. The cylindrical label mounting area must support the wrap-around label and must absorb a vacuum without losing its cylindrical label mounting shape.

These problems could be alleviated by increasing the thickness of the container wall. However, increasing the wall thickness results in an increase in weight for the container and in the material cost of the finished container, which results are not acceptable to the container industry. Accordingly, attempts to solve this problem have been directed to adding reinforcements to the container sidewall.

In U.S. Pat. No. 4,863,046, there is disclosed a hot-fill container which has a cylindrical main body portion which includes a plurality of vertically oriented pressure panels separated by vertically elongated land areas. The vertically elongated land areas between the pressure panels are reinforced by vertical ribs. Each of the pressure panels includes a plurality of transverse, radially recessed rib segments within the panel which ensure that the panel moves uniformly. The pressure panels extend from just below the upper label bumper to just above the lower label bumper, minimizing the area for securing the label to the container body. Label placement is critical because the areas above and below the panels for placement of the upper and lower edges of the label are relatively small. This imposes significant constraints on the manufacturing tolerances in applying the label to the container.

In another hot-fill container, which is disclosed in U S Pat. No. 4,805,788, the container sidewall includes a plurality of vacuum collapse panels each of which has longitudinally extending ribs disposed at the sides of the collapse panels. The ribs extend within the sides of the vacuum panels and terminate at the tops and bottoms of the vacuum panels, increasing the rigidity of the container.

Another consideration is that certain markets require hot-fill containers with a one to two liter capacity while being characterized by a high aspect ratio, that is, the ratio of the vertical height of the container to the diameter of the container being greater than 2.5 to 1. One approach to producing such containers involved elongating an existing smaller capacity hot fill container of the type having an outwardly projecting window area in the center of the vacuum panel. This required lengthening the vacuum panel. However, the larger window limited the area for the window to flex inwardly in compensating for vacuum created during hot filling of the container so that the panel tended to buckle at its center. Moreover, under side loading pressure, the container collapsed at the base of the vertical column or land area separating adjacent panels.

The principle mode of failure in such containers was non-recoverable buckling, due to weakness in the lower label section, under vacuum, during handling of the containers between the cooling tunnel and the labeler. Essentially, the vertical column between two adjacent vacuum absorption panels buckled at the lower end of the panels, producing a flat section. This buckling is only recoverable if the container is "shocked" by striking its base with an abrupt force to "pop" the container geometry back to its normal shape. Containers which buckle in this way cannot be labeled properly.

One known hot-fill container includes a plurality of vertically oriented vacuum panels separated by vertically elongated land areas, and each vacuum panel includes an outwardly projecting center portion which is adapted to flex inwardly under vacuum conditions. A small upset provided at the top and bottom edges of the vacuum panel enables the vacuum panel to resist taking a permanent set when the vacuum panel is pushed inwardly. However, this upset was not effective to prevent the vertical land areas on either side of a vacuum panel from taking a permanent set when the land area is deflected inwardly.

SUMMARY OF THE INVENTION

The present invention provides a thin-walled plastic container formed from a plastic or polyester material which is adapted to contain a liquid at a temperature elevated above room temperature. The container includes a plurality of pressure or vacuum absorption panels which are adapted to flex inwardly upon a lowering of interior pressure during cooling of the liquid. In accordance with the invention, each vacuum absorption panel includes an outwardly projecting portion which extends between the upper and lower edges of the vacuum panel. The projecting portion has at least one raised panel portion and at least one, and preferably two connecting portions which connect the raised panel portions to the peripheral edge of the vacuum panel at the top and bottom of the panel. The connecting portions hold the vacuum panel rigidly at its edges, but allow the outwardly projecting panel portions and the connecting portions to flex inwardly. The outwardly projecting connecting portions reverse the direction of the plane of the vacuum panel in the region between the panel portions and the top and bottom of the vacuum panel, providing a reinforced surface which strengthens the vacuum panel at its upper and lower edges. This reinforcement substantially prevents the container sidewall from taking a permanent set when deflected inwardly, particularly at the top or the base of vertical land areas which separate adjacent vacuum panels. Further in accordance with the invention, the radius of curvature of the corners of the vacuum panel is relatively large. This stiffens the vacuum panel at its corners, providing increased strength at the corners of the vacuum panel. Additionally, the container includes reinforcement ribs in the sidewall above and below the vacuum absorption panels which support the panels at their upper and lower edges, making the container sidewall more resistant to inward deflection.

In accordance with a feature of the invention, the vacuum absorption panel includes a transverse rib or cross bar portion which divides the outwardly projecting raised portion of the vacuum absorption panel into upper and lower panel portions. Dividing a single outwardly projecting large panel portion into two smaller panel portions with a strengthening rib extending transversely between the two panel portions had the unexpected result of providing more compliance and better response to vacuum conditions than is provided by a single larger panel portion of comparable vertical height. Moreover, the strengthening rib enables the two panel portions to flex inwardly, independently of one another so that the outwardly projecting panel portions do not collapse inwardly at the center of the vacuum panel.

Other advantages and features of the invention will become apparent from the detailed description which makes reference to the following drawings.

DESCRIPTION OF A PREFERRED EMBODIMENT

Figure 1:
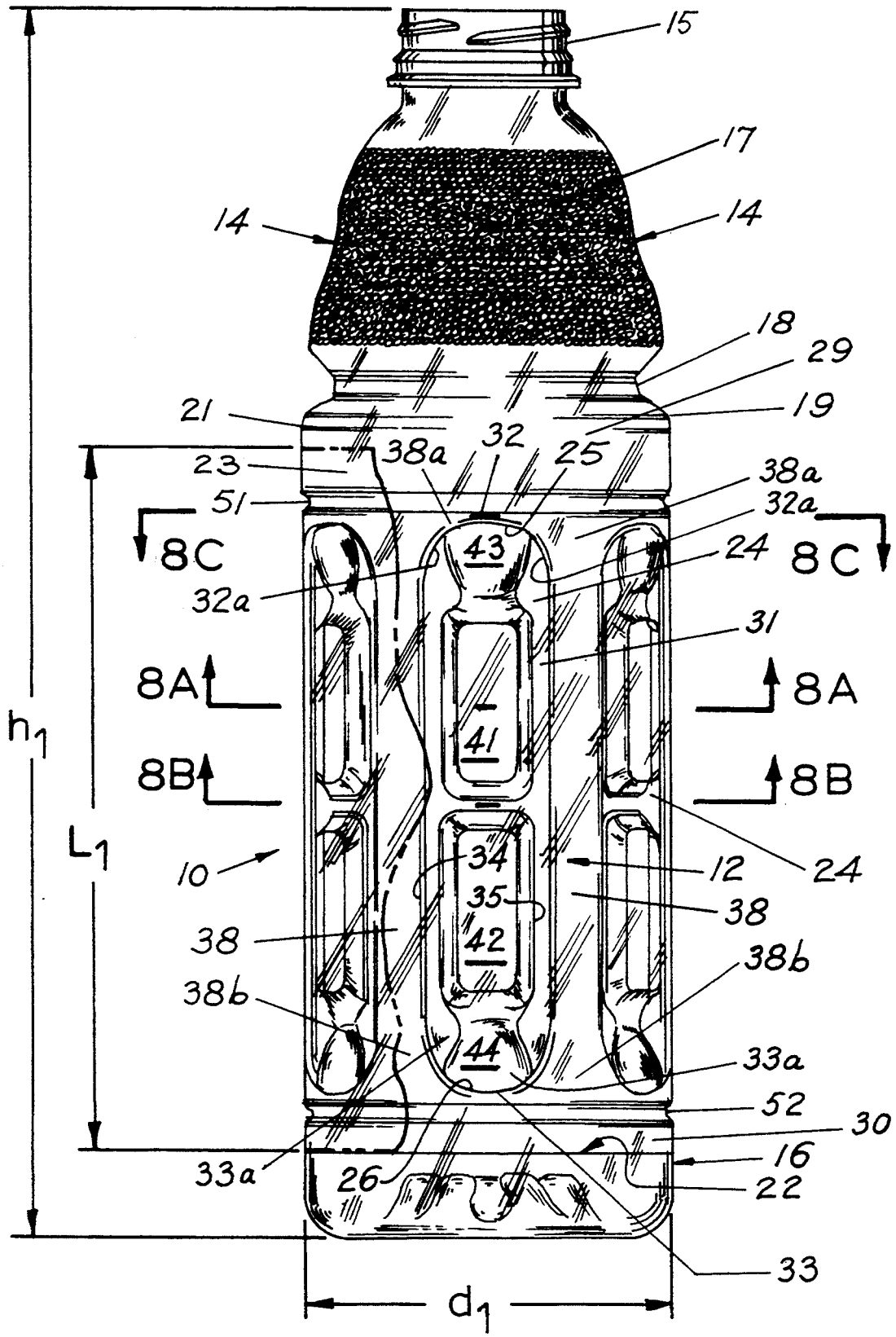
FIG. 1 is an elevation view of a hot-fill container provided by the present invention.

Referring to the drawings, the container of this invention, indicated generally at 10, is illustrated in FIG. 1 as having a sidewall 12 of generally round cylindrical shape, an upper portion 14 defining a sealable closure receiving portion 15, and a base portion 16 closing the bottom of the container. The sidewall 12 is formed integrally with and extends between the upper portion 14 and the base portion 16. The upper portion 14, which is located between the sidewall 12 and the closure receiving portion 15, includes a generally dome shaped portion 17, a narrow waist portion 18 and an annular shoulder 19. The annular shoulder 19, which is located at the transition between the container sidewall 12 and the upper portion 14 of the container, defines an upper label bumper 21. Similarly, at the transition between the container sidewall 12 and the base portion 16 of the container, the annular upper edge of the base portion 16 defines a lower label bumper 22. A full wrap label 23 is applied to the container sidewall 12 between the upper and lower label bumpers and is secured to the sidewall in a suitable manner as is known in the art.

Figure 8A:
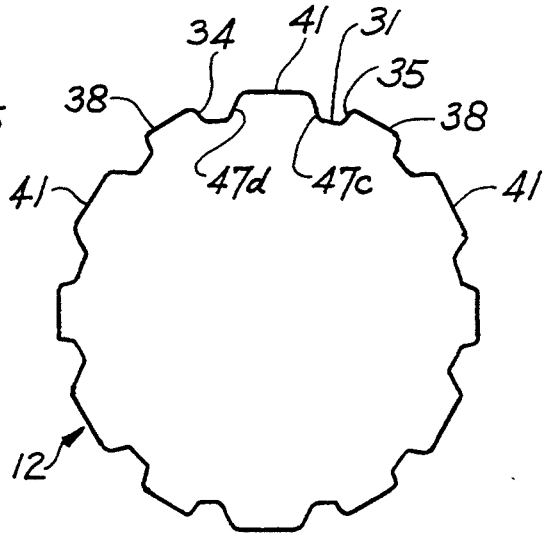
FIGS. 8A, 8B and 8C are simplified transverse section views taken along respective lines A—A, B—B and C—C of FIG. 1, but are not true, complete section views.
Figure 8B:
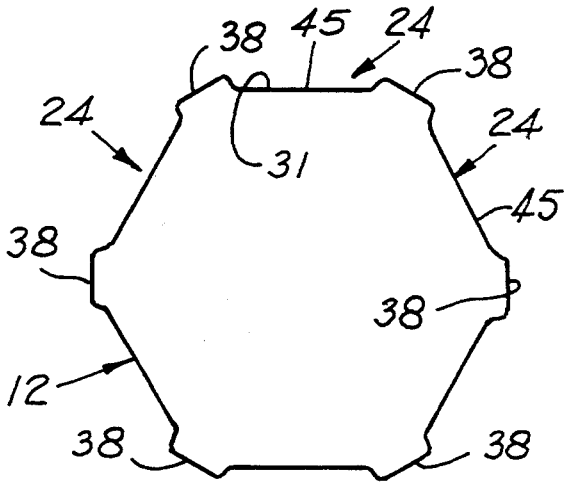
Figure 8C:
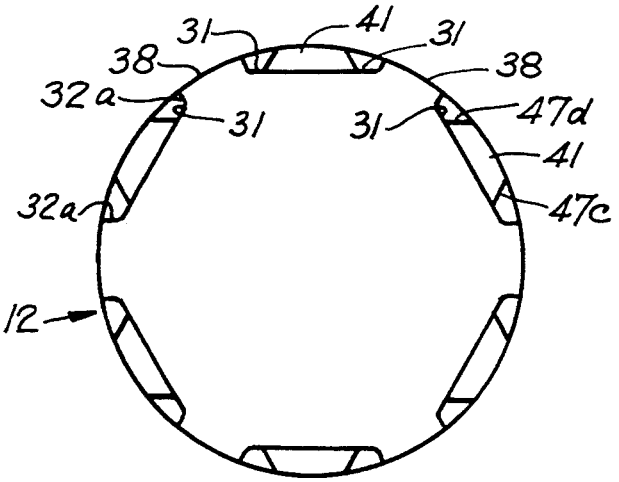

The container 10 is a "hot-fill" container which is adapted to contain a liquid at a temperature elevated above room temperature, and typically above temperatures of sterilization or pasteurization. While the term hot fill has typically encompassed a plastic container which is filled with a liquid at a temperature above room temperature and then capped, the term hot fill with respect to the disclosed invention also encompasses filling the container with a liquid and subsequently heating the liquid and the container, which also allows for pasteurization type processing within the filled container. The container is formed in a blow mold and is produced from a polyester or other plastic material, such as polyethylene terephthalate (PET). The sidewall 12 includes a plurality of vertically elongated oriented pressure or vacuum absorption panels 24, six in the container 10 illustrated in FIG. 1, which are disposed about the circumference of the container, spaced apart from one another by smooth, vertically elongated land areas or columns 38 as is illustrated in FIGS. 8A, 8B and 8C, which are simplified transverse section views taken along the section lines A—A, B—B and C—C of FIG. 1 which illustrate the shape of the sidewall 12 at the section lines. However, FIGS. 8A, 8B and 8C are not true, complete section views.

The pressure or vacuum absorption panels, hereinafter referred to as vacuum panels, are adapted to flex inwardly upon a lowering of internal pressure during cooling of the liquid. In addition, the base portion 16 may be adapted to deflect upwardly and inwardly in response to the hot fill process as is known in the art. During the hot fill process, the vacuum panels 24 of container 10 operate in conjunction with the base portion 16 to compensate for the hot fill vacuum or lowered pressure.

The portion of the sidewall which extends between the upper label bumper and the lower label bumper is commonly referred to as the label panel which includes flat surfaces which facilitate securing the label 23 to the container. The vacuum panels 24 are located in the label panel between the upper label bumper 21 and the lower label bumper 22, and thus are covered by the label 23. The marginal area 29 between the upper edges 25 of the vacuum panels and the upper label bumper 21 defines a flat label upper mounting panel and the marginal area 30 between the lower edges 26 of the vacuum panels 24 and the lower label bumper 22 defines a flat label lower mounting panel. The label 23 has its upper and lower edges glued to the upper and label lower mounting panels in the conventional manner.

Figure 2:
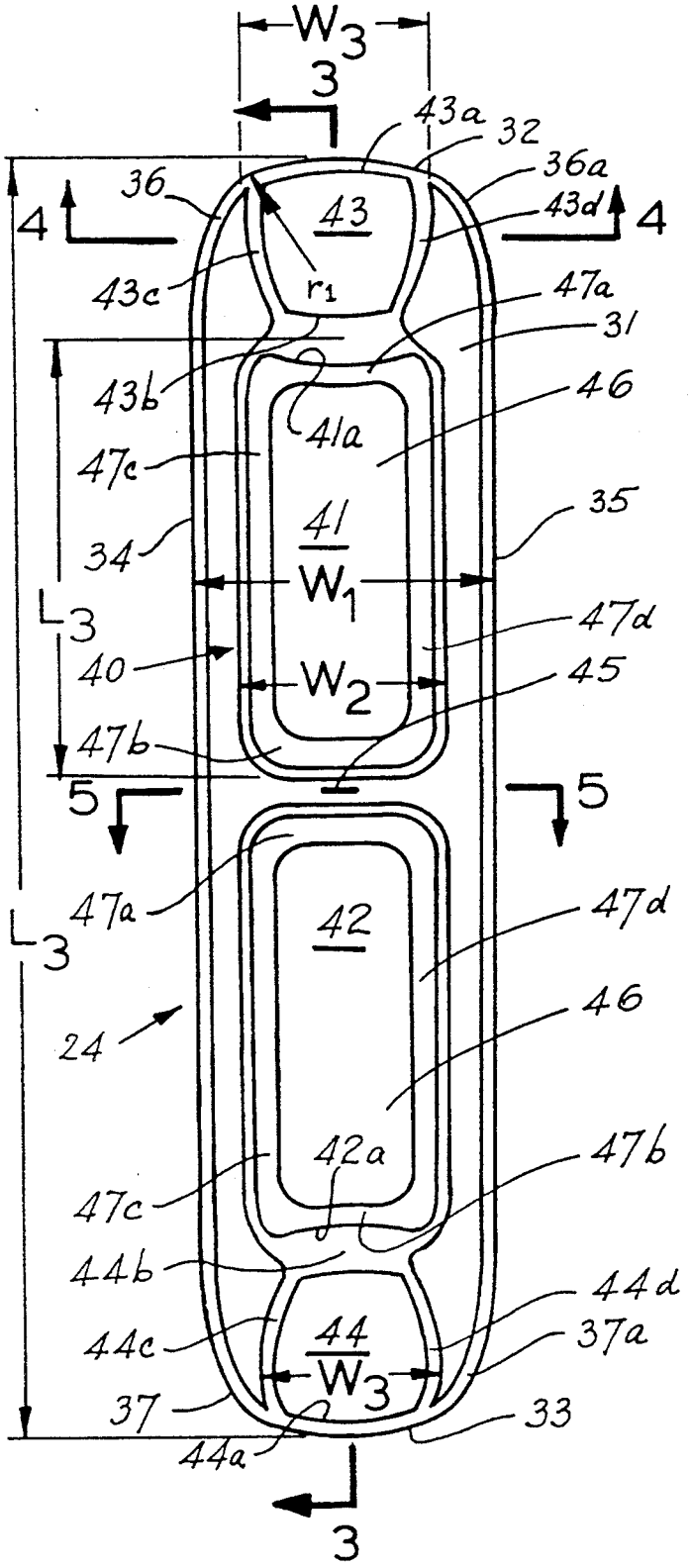
FIG. 2 is an enlarged elevation view of a vacuum absorption panel of the hot-fill container shown in FIG. 1.
Figure 3:
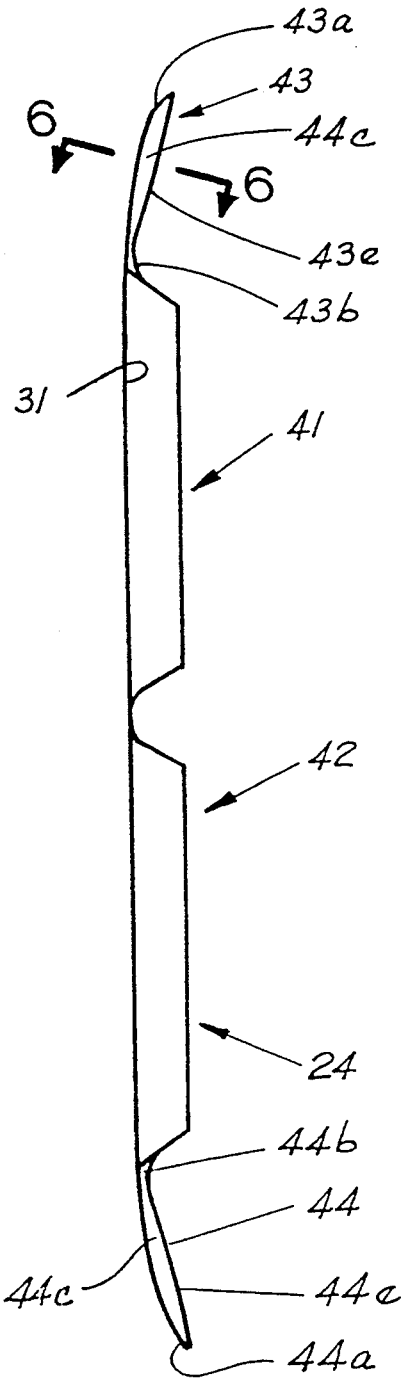
FIG. 3 is a vertical section view taken along the line 3—3 of FIG. 2.
Figure 4:
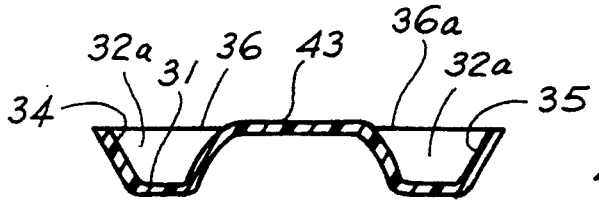
FIG. 4 is a transverse section view taken along the line 4—4 of FIG. 2.
Figure 5:
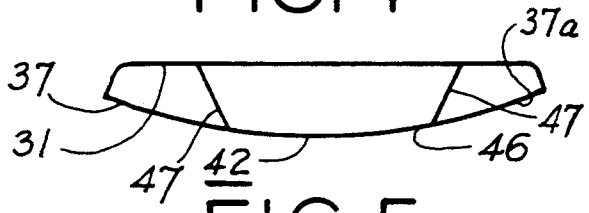
FIG. 5 is a transverse section view taken along the line 5—5 of FIG. 2.

Referring additionally to FIGS. 2–4, each vacuum panel includes a vertically elongated back surface 31, an upper edge or curved top 32, a lower edge or curved bottom 33 and a pair of generally parallel vertical sides 34 and 35. The curved top 32 defines the upper edge of the vacuum panel. The curved bottom 33 defines the lower edge of the vacuum panel. The sides 34 and 35 define the side edges of the vacuum panel.

Figure 7:
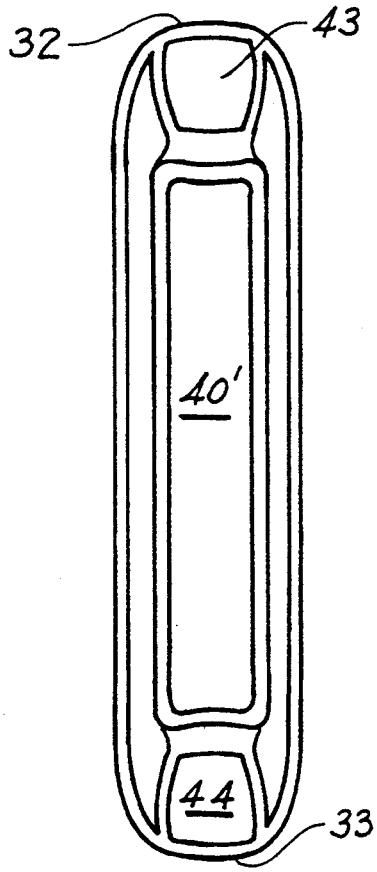
FIG. 7 is a front view of further embodiment for a vacuum absorption panel for a hot-fill container.

The vacuum panel includes further an elongated outwardly projecting portion 40 which extends between its upper edge 32 and its lower edge 33. The outwardly projecting portion 40 includes an upper raised center panel portion 41, a lower raised center panel portion 42 and a pair of outwardly projecting portions 43 and 44. Portion 43 connects the upper raised center panel portion 41 to the upper edge 32 of the vacuum panel 24. Portion 44 connects the lower raised center panel portion 42 to the lower edge of the vacuum panel 24. The outwardly projecting panel portion may be a single panel portion 40' having its upper and lower edge connected to the top 32 and bottom 33 of the vacuum panel by outwardly projecting portions 43 and 44, as shown in FIG. 7.

Although the outwardly projecting portions 43 and 44 are integral portions of the vacuum panel, these portions connect or tie the center raised panels to the edges of the vacuum panel in such a manner as to control the inward flexing of the raised panel center portions as will be described. Accordingly, the portions 43 and 44 of the vacuum panel are referred to as connecting portions.

The back surface 31 of the vacuum panel is recessed relative to the outer surface of the container sidewall. The sides 34 and 35 taper inwardly from the sidewall to the back surface 31 of the vacuum panel 24. The portions **32*a* of the top 32 on either side of the connecting portion 43 taper inwardly from the outer surface of the sidewall to the back surface 31 as shown in FIGS. 1, 4 and 8C. Similarly, the portions 33*a* of the bottom 33 on either side of connecting portion 44 taper inwardly from the outer surface of the sidewall to the back surface 31**. Thus, the vacuum panel curves convex inwardly relative to the outer surface of the sidewall.

Referring to FIGS. 1 and 2, the curved top 32 at the upper edge of the vacuum panel has arcuately shaped corners 36 and **36*a* and the curved bottom at the lower edge 33 of the vacuum panel has arcuately shaped corners 37 and 37*a*. The radius of curvature $r_1$ of each of the corners is in the range of about 10 mm to about 12 mm and for one container that was produced, the radius of curvature $r_1$ was 11.28 mm. The large radius of curvature makes the vacuum panels more rigid at their corners and increases the size of the sidewall at the corners of the vacuum panels as compared to a generally rectangular shaped vacuum panel of comparable length and width. That is, because of the relatively large radius of curvature for the corners 37 and 37*a*, the portions 38*a* of the column or land area 38 are generally trapezoidal in appearance. Similarly, because of the large radius of curvature for corners 36 and 36*a*, the portions 38*b* of the column 38 have the general appearance of an inverted trapezoid. Increasing the radius of the corners reduces the area of the vacuum panel as compared to a comparably sized generally rectangular vacuum panel. The provision of the two raised center portions 41 and 42** renders the vacuum panel more compliant and more responsive to pressure effects, more than compensating for the decrease in the area of the vacuum panel.

Referring to FIGS. 2, 3, 5, 8A and 8B, the panel portions 41 and 42 are generally rectangular in shape and extend along the center of the vacuum panel, oriented vertically within the panel. Each of the panel portions 41 and 42 has a top 46 and four sidewalls **47*a*–47*d* which slope inwardly to the back surface 31 of the vacuum panel at an angle of approximately 60 degrees. The upper sidewall 47*a* of panel portion 41 defines the upper edge 41*a* of panel portion 41 and merges into the upper connecting portion 43. Similarly, the lower sidewall 47*b* of panel portion 42 defines the lower edge 42*a* of panel portion 42 and merges into the lower connecting portion 44. The upper sidewall 47*a* of panel portion 41 and the lower sidewall 47*b* of panel portion 42 slope inwardly to the connecting portion 43 at a more shallow angle, such as 54 degrees. The panel portions 41 and 42 are spaced one from the other and from the top edge 32 and bottom edge 33, respectively, of the vacuum panel. The panel portions 41 and 42 at the center of vacuum panel are separated at their adjacent edges by a transverse section 45 which extends the width of the vacuum panel. Although this section 45 is coplanar with the back surface of the vacuum panel, it functions as a rib or cross bar which defines a reinforced region between the two panel portions 41 and 42 and accordingly, is referred to as transverse rib 45**.

Figure 9:
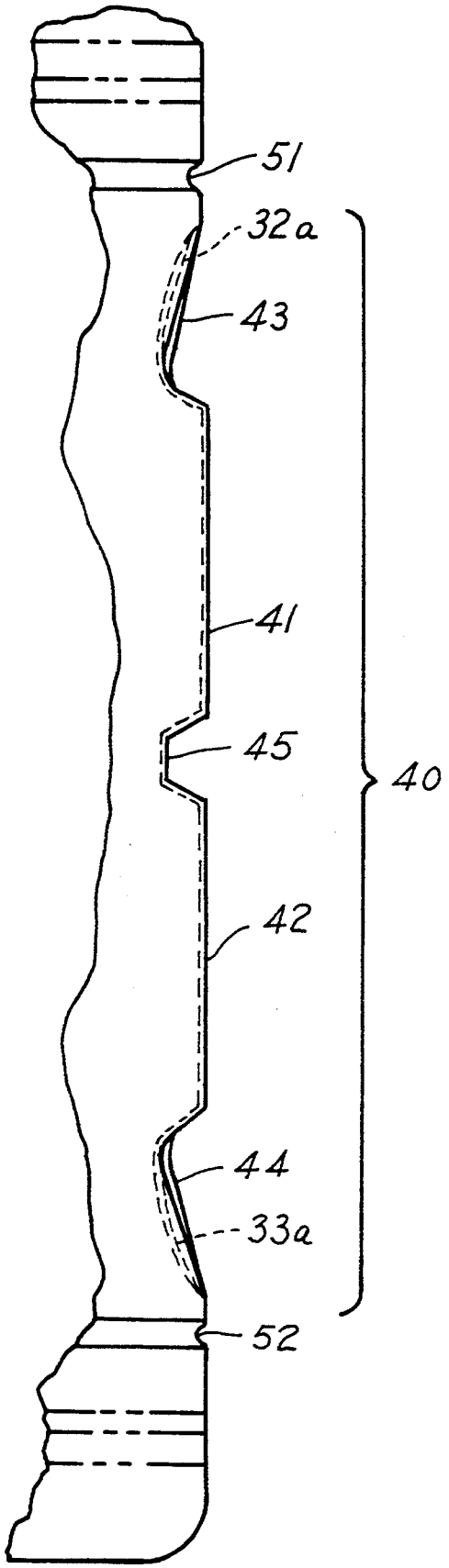
FIG. 9 is a fragmentary vertical view of the container of FIG. 1 illustrating with the vacuum absorption panel shown in solid lines in the at rest position and in phantom under vacuum conditions.

It has been found that two panel portions are more responsive to vacuum and pressure changes than a single large panel of comparable size, such as panel portion 40' illustrated in FIG. 7. The transverse rib 45 acts as a hinge for the two panel portions 41 and 42, enabling the two panel portions 41 and 42 to flex inwardly about the rib 45 and independently of one another, in such a manner that the outwardly projecting center portion 40 does not collapse inwardly or deform at any region within the center of the panel portion. Referring to FIG. 9, the panel portions 41 and 42 and the connecting portions 43 and 44 of the vacuum panel are shown by solid lines in the at rest position and in phantom under a pressure or vacuum reduction condition. As is illustrated in FIG. 9, in response to a vacuum or pressure reduction condition, the connecting portions 43 and 44 flex slightly inward, moving inwardly the upper edge **41*a* of panel portion 41 and the lower edge 42*b* of the panel portion 42. In addition, the adjacent inner edges 41*b* and 42*a* of the panel portions 41 and 42, which are connected together by the rib 45, flex inwardly independently of one another, each pivoting about a hinge axis defined by the rib 45**.

Figure 6:
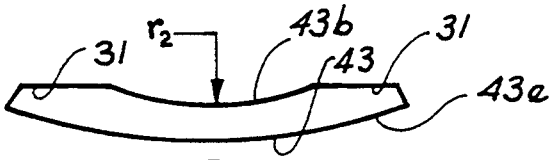
FIG. 6 is a transverse section view taken along the line 6—6 of FIG. 3.

Referring to FIGS. 2, 3 and 6, the connecting portions 43 and 44 are identical in size and shape but are oriented in mirror image symmetry at the upper and lower edges, respectively, of the vacuum panel. The connecting portion 43 has an outer edge 43*a*, an inner edge 43*b* and side edges 43*c* and 43*d*. The outer edge 43*a* merges with the panel upper edge 32 and the inner edge 43*b* merges with the upper edge 41*a* of the upper panel portion 41. The vertical and lateral extent of the connecting portion 43 is such as to form substantially the entire region between the upper edge 32 and the upper panel portion 41. The connecting portion 43 spans the vertical distance between the upper edge 32 and vacuum panel portion 41.

Similarly, the connecting portion 44 has an outer edge 44*a*, an inner edge 44*b* and side edges 44*c* and 44*d*. The outer edge 44*a* merges with the panel upper edge 33 and the inner edge 44*b* merges with the lower edge 42*a* of the lower panel portion 42. The connecting portion 44 spans the vertical distance between the lower edge 33 and the vacuum panel portion 42. The vertical and lateral extent of the connecting portion 44 is such as to form substantially the entire region between the lower edge 33 and the lower panel portion 42. The connecting portions 43 and 44 are an integral portion of the vacuum panel and are of substantially the same thickness as the back surface 31 and the panel portions 41 and 42. However, although the curvature of the vacuum panel is convex inwardly, the curvature of the connecting portions 43 and 44 is convex outwardly.

Referring to FIGS. 2–4 and 6, the connecting portions are arcuate, or convex outwardly, in transverse cross section and thus bow outwardly between their side edges, such as side edges 43*c* and 43*d* for connecting portion 43, defining a segment of a vertically extending cylinder. The radius of curvature $r_2$ of the connecting portions is approximately 30 mm. However, the outer surface 43*e* of connecting portion 43 and outer surface 44*e* of connecting portion 44 are not curved between their respective outer edges 43*a* and 44*a* and inner edges 43*b* and 44*b*. The connecting portions 43 and 44 taper inwardly from their outer edges to the inner panel section, and thus are wider at their outer edges than at their inner edges, decreasing in transverse width in a direction from the edge of the panel portion to the respective panel portions.

As is shown in FIGS. 4 and 8A–8C, although the vacuum panel has raised center portions, the panel back surface 31 is recessed relative to the outer surface of the sidewall. The sides of the vacuum panel extend convex inwardly whereas the connecting portions, such as connecting portion 43, extend convex outwardly. Thus, the connecting portion 43 changes the geometry of the portion of the vacuum panel in the region between the upper edge of the upper panel portion and the upper edge of the vacuum panel. Similarly, the connecting portion 44 changes the geometry of the portion of the vacuum panel in the region between the lower edge of panel portion 42 and the lower edge of the vacuum panel. These reversals in the configuration or shape of the vacuum panel at its upper and lower edges provide segments of vertically extending generally cylindrically shaped reinforced sections, which strengthen the vacuum panel at its upper and lower edges and prevent the portion of the sidewall along the upper edge and the panel lower edge, including the base and top of the columns 38, from taking a permanent set when deflected inward while the container is sealed and under a vacuum condition.

Referring to FIG. 1, the container sidewall portion 12 includes two inwardly directed reinforcement ribs 51 and 52 which supplement the function of the radial corners of the vacuum panels and the reinforcements in the panel upper and lower edge regions. One of the reinforcement ribs 51 is located in the label upper panel 29 between the upper edges 25 of the vacuum panels 24 and the upper label bumper 21, but closer to the panel upper edges 25 than to the upper label bumper 21. The other reinforcement rib 52 is located in the label lower panel 30 between the lower edges 26 of the vacuum panels 24 and the lower label bumper 22, but closer to the panel lower edges 26 than to the lower label bumper 22. The annular reinforcement ribs 51 and 52 are continuous and extend around the inner circumference of the sidewall.

The reinforcement ribs 51 and 52 each are generally semicylindrical in shape and are directed radially inward, as illustrated in FIGS. 1 and 8, relative to the portions of the sidewall which define the upper label mounting area 29 and the lower label mounting area 30. The annular ribs 51 and 52 are rigid and do not expand or contract under vacuum conditions. For one 1.5 liter container which was produced having an outer diameter of approximately 92 mm , the radius of each of the reinforcement ribs 51 and 52 was approximately 1.16 mm. The center line of the reinforcement rib 51 was located approximately 28 mm from the upper edge 25 of the vacuum panels. The centerline of the reinforcement rib 52 was located approximately 28 mm from the lower edge 26 of the vacuum panels. The size of the reinforcement ribs is a function of the size of the container, and by way of example, could be increased from the value given in proportion to an increase in the dimensions of the container from the dimensions given for the exemplary container 10. These ribs are discussed in more detail in the cross referenced application.

The inward flexing of the vacuum panels 24 caused by the hot fill vacuum creates high stress points, at the top corners 36 and 36*a* of the vacuum panels 24 and at the bottom corners 37 and 37*a* of the vacuum panels 24, which otherwise would flex inwardly, causing the container sidewall to collapse. The radial reinforcement ribs 51 and 52 which are molded concentric with the label upper panel 29 and the label lower panel 30 support the vacuum panels along their upper and lower edges, holding the edges fixed while permitting the center portions of the vacuum panels 24 to flex freely inward and without deforming the panels so that the vacuum panels operate in conjunction with the base 16 to allow the container to contract somewhat in volume to compensate for the volume shrinkage of the hot filled liquid as the liquid cools. In addition, the reinforcement ribs strengthen the cylindrical portions of the sidewall between the panel upper and lower edges and the label upper and lower bumpers, enabling the upper and lower label mounting areas to resist the vacuum deformation.

The reinforcement ribs support the vacuum panels at their upper and lower edges, making the side wall more rigid at the top and bottom edges of the vacuum panels 24. This reinforcement makes the container sidewall, including the vacuum panels, less susceptible to deformation in shipping and handling of the container. A secondary benefit is that the reinforcement ribs permit smaller size vacuum panels to be used so that the size of the upper and lower label panels is increased for a given size container. Moreover, because of the increased size of the label upper and lower mounting panels, label placement is not as critical, resulting in more flexibility in the process for applying the label to the container.

The hot-fill container provided by the present invention, is characterized by a high aspect ratio. The aspect ratio is defined as the ratio of the vertical height of the container to the diameter of the container. For example, aspect ratios in the order of about 2.5 to 1 to about 3.5 to 1 and vacuum or pressure panels having a ratio of vertical length to transverse width are attainable for a container including reinforcements in accordance with the principles of the present invention.

Referring to FIGS. 1 and 2, one hot-fill plastic container which was produced having an overall height $h_1$ of approximately 298 mm and an outer diameter $d_1$ of approximately 91.5 mm had an aspect ratio of approximately 3.26 to 1. The vertical length $L_1$ of the label mounting area was approximately 171 mm. The surface area of the label panel was approximately 489 $mm^2$. The vertical length $L_2$ of the vacuum panel was approximately 141 mm, and the transverse width $W_1$ of the vacuum panels was approximately 34 mm. The surface area of each vacuum panel was approximately 46.6 $mm^2$. The ratio of the surface area of the label panel to the total surface area for six vacuum panels was approximately 1.75 to 1. The surface area of the six vacuum panels was 57% of the total surface area of the label panel. The ratio of the vertical length of the vacuum panel to the transverse width of the vacuum panel for that container was approximately 4.15 to 1. The vertical length $L_3$ of each panel portion, at the base of sides 47, was approximately 51 mm and the transverse width $W_2$ of each panel portion, at the base of the sides 47, was approximately 23 mm. The ratio of the vertical length $L_2$ of the vacuum panel to the vertical length $L_3$ of one of the panel portions was approximately 2.78. The transverse width $W_3$ of the connecting portions 43 and 44 in the proximity of respective edges 32 and 33 of the vacuum panel corresponds to the transverse width $W_2$ of the corresponding panel portion.

Thus, it can be seen that the present invention provides a plastic container for hot-fill applications which has an improved sidewall construction. The sidewall includes an outwardly projecting portion extending between the upper and lower edges of the vacuum panel. The outwardly projecting portion includes one or more raised center panel portions and, preferably, two outwardly projecting connecting portions which connect the raised center panel portions to the peripheral edge of the vacuum panel at the top and bottom of the panel. The connecting portions maintain the vacuum panel rigid at its edges, while permitting the panel portions and the connecting portions to flex inwardly. The connecting portions reverse the direction of the plane of the vacuum panel in the region between the panel portions and the top and bottom of the vacuum panel, strengthening the vacuum panel at its upper and lower edges. In the illustrated embodiments, the vacuum panel projects inwardly relative to the outer surface of the container, and the connecting portions change the geometry of the vacuum panel from convex inward to convex outward, so that the portions of the vacuum panel between the raised center panel portions and the upper and lower edges of the vacuum panel curve outwardly, providing reinforcement at the top and bottom of the vacuum panel. This reinforcement substantially prevents the container sidewall from taking a permanent set, particularly when deflected inwardly at the top or at the base of the vertical land areas which separate adjacent vacuum panels. The radius of curvature of the corners of the vacuum panel is relatively large so that the periphery of the vacuum panel is generally elliptical in shape having straight vertical sides. This stiffens the vacuum panel at its corners, providing increased strength at the corners of the vacuum panel and at the sidewall adjacent to the corners of the vacuum panel. The transverse rib, which divides the outwardly projecting panel center portion into upper and lower panel portions, increases the compliance of the vacuum panel and its response to vacuum or pressure reduction conditions. The reinforcement ribs provided in the container sidewall above and below the vacuum panels support the vacuum panels at their upper and lower edges, enabling the container sidewall to resist inward deflection.

The invention has been described with reference to a preferred embodiment and is not limited to the exact construction or method illustrated, it being understood that various changes and modifications may be made without departing from the spirit, or scope of the invention as defined in the following claims.

We claim:

1. A thin-walled container formed from a plastic material and adapted to contain a liquid at a temperature elevated above room temperature, said container comprising: an upper portion which includes a sealable closure receiving portion; a lower portion including a base closing the bottom of the container; and a sidewall extending between said upper and lower portions, said sidewall being generally tubular in shape and including a plurality of elongated, vertically oriented vacuum panels, said vacuum panels being adapted to flex inwardly upon a lowering of internal pressure during cooling of said liquid, each of said vacuum panels having an upper edge, a lower edge, and an elongated outwardly projecting portion extending from said upper edge to said lower edge of said vacuum panel.

2. The container according to claim 1, wherein said outwardly projecting portion includes at least one raised center portion and first and second connecting portions connecting said raised center portion to said upper and lower edges, respectively, of said vacuum panel.

3. A thin-walled container formed from a plastic material and adapted to contain a liquid at a temperature elevated above room temperature, said container comprising: an upper portion which includes a sealable closure receiving portion; a lower portion including a base closing the bottom of the container; and a sidewall extending between said upper and lower portions, said sidewall being generally tubular in shape and including a plurality of elongated, vertically oriented vacuum panels, said vacuum panels being adapted to flex inwardly upon a lowering of internal pressure during cooling of said liquid, each of said vacuum panels having an upper edge, a lower edge, and an elongated outwardly projecting panel portion extending between and spaced from said panel upper and lower edges, and at least one connecting portion extending between one edge of said outwardly projecting panel portion and one of said edges of said vacuum panel, said connecting portion connecting said one edge of said outwardly projecting panel portion to said side wall along said one edge of said vacuum panel, said connecting portion projecting outwardly in a manner to control the inward flexing of said panel portion.

4. The container according to claim 3, wherein said connecting portion reverses the curvature of said vacuum panel adjacent to the portion of said sidewall extending along said one edge of said vacuum panel.

5. The container according to claim 3, wherein the transverse width of said connecting portion increases in a direction from said one edge of said panel portion to said one edge of said vacuum panel.

6. The container according to claim 5, wherein said panel portion is generally rectangular in shape and the transverse width of said connecting portion in the proximity of said one edge of said vacuum panel corresponds to the transverse width of said panel portion.

7. The container according to claim 3, wherein said connecting portion extends between said upper edge of said vacuum panel and an upper edge of said panel portion, and including a second connecting portion extending between said lower edge of said vacuum panel and a lower edge of said panel portion.

8. The container according to claim 7, wherein said vacuum panel includes a transverse rib dividing said panel portion into upper and lower vertically oriented panel portions extending between said upper and lower edges of said vacuum panel.

9. The container according to claim 3, wherein said vacuum panel has first and second parallel vertical sides connected to said upper and lower edges of said vacuum panel by arcuately shaped corners having a radius of curvature in the range of about 10 to 12 mm.

10. The container according to claim 3, and including a first annular reinforcement rib located in said sidewall above said vacuum panels and a second annular reinforcement rib located in said sidewall below said vacuum panels, said first and second annular ribs extending continuously around the inner circumference of said sidewall, supporting said vacuum panels at their upper and lower edges.

11. A thin-walled container formed from a plastic material and adapted to contain a liquid at a temperature elevated above room temperature, said container comprising: an upper portion which includes a sealable closure receiving portion; a lower portion including a base closing the bottom of the container; and a sidewall extending between said upper portion and said lower portion, said sidewall being generally tubular in shape and including a plurality of elongated vertically oriented vacuum panels which are adapted to flex inwardly upon a lowering of internal pressure during cooling of said liquid, each of said vacuum panels having an upper edge and a lower edge, an elongated outwardly projecting portion extending between and spaced from said upper and lower edges of said vacuum panel and oriented vertically within said vacuum panel, and a transverse rib dividing said outwardly projecting portion into upper and lower panel portions, said vacuum panel including a first outward projecting connecting portion extending between an upper edge of said upper panel portion and said upper edge of said vacuum panel and connecting said upper edge of said upper panel portion to said sidewall along said panel upper edge, and a second outwardly projecting connecting portion extending between a lower edge of said lower panel portion and said lower edge of said vacuum panel and connecting said lower edge of said lower panel portion to said sidewall along said lower edge of said vacuum panel.

12. The container according to claim 11, wherein said connecting portions reverse the curvature of said vacuum panel in the region between said upper and lower panel portions and the sidewall portions extending along said upper and lower edges of said vacuum panel.

13. The container according to claim 11, wherein the transverse width of each of said connecting portions increases in a direction from said edges of said upper and lower panel portions to said upper and lower edges of said vacuum panel.

14. The container according to claim 11, wherein said upper and lower panel portions are generally rectangular in shape, and wherein the transverse width of said connecting portions in the proximity of said panel edges corresponds to the transverse width of said upper and lower panel portions.

15. The container according to claim 11, wherein said vacuum panel has first and second parallel vertical sides connected to said upper and lower edges of said vacuum panel by arcuately shaped corners having a radius of curvature in the range of about 10 to 12 mm.

16. The container according to claim 11, and including a first annular reinforcement rib located in said sidewall adjacent to the upper edges of said vacuum panels and a second reinforcement rib located in said sidewall adjacent to the lower edges of said vacuum panels, said first and second annular ribs extending continuously around the inner circumference of said sidewall, supporting said vacuum panels at their upper and lower edges.

17. A thin-walled container formed from a plastic material and adapted to contain a liquid at a temperature elevated above room temperature, said container comprising: an upper portion which includes a sealable closure receiving portion; a lower portion including a base closing the bottom of the container; and a sidewall extending between said upper portion and said lower portion; said sidewall being generally tubular in shape and including a plurality of elongated vertically oriented vacuum panels which are adapted to flex inwardly upon lowering of internal pressure during cooling of said liquid, each of said vacuum panels having an upper edge and a lower edge, an outwardly projecting portion extending between and spaced from said upper and lower edges, and a transverse rib dividing said outwardly projecting portion into upper and lower panel portions which extend between said upper and lower edges of said vacuum panel and are oriented vertically within said vacuum panel, said upper edges of said vacuum panels being spaced from said container upper portion defining a label upper mounting area and said lower edges of said vacuum panels being spaced from said container lower portion defining a label lower mounting area, a first annular reinforcement rib located in said label upper mounting area adjacent to the upper edges of said vacuum panels and a second reinforcement rib located in said lower label mounting area adjacent to the lower edges of said vacuum panels, said first and second annular ribs extending continuously around the inner circumference of said sidewall, supporting said vacuum panels at their upper and lower edges, and said first annular reinforcement rib being located closer to said upper edges of said vacuum panels than to said container upper portion and said second annular reinforcement rib being located closer to said lower edges of said vacuum panels than to said container lower portion.

18. A thin-walled container formed from a plastic material and adapted to contain a liquid at a temperature elevated above room temperature, said container comprising: an upper portion which includes a sealable closure receiving portion; a lower portion including a base closing the bottom of the container; and a sidewall extending between said upper portion and said lower portion; said sidewall being generally tubular in shape and including a plurality of elongated vertically oriented vacuum panels which are adapted to flex inwardly upon lowering of internal pressure during cooling of said liquid, each of said vacuum panels having an upper edge and a lower edge, an outwardly projecting portion extending between and spaced from said upper and lower edges, and a transverse rib dividing said outwardly projecting portion into upper and lower panel portions which extend between said upper and lower edges of said vacuum panel and are oriented vertically within said vacuum panel, said vacuum panel having first and second parallel vertical sides connected to said upper and lower edges of said vacuum panel by arcuately shaped corners having a radius of curvature in the range of about 10 to 12 mm.

19. A thin-walled container formed from a plastic material and adapted to contain a liquid at a temperature elevated above room temperature, said container comprising: an upper portion which includes a sealable closure receiving portion; a lower portion including a base closing the bottom of the container; and a sidewall extending between said upper portion and said lower portion; said sidewall being generally tubular in shape and including a plurality of vacuum panels, each including elongated, outwardly projecting upper and lower panel portions, the ratio of the overall height of said container to the diameter of said sidewall being at least 3 to 1.

20. The container according to claim 19, wherein the ratio of the overall height of said container to the diameter of said sidewall is approximately 3.26 to 1.

21. The container according to claim 19, wherein the ratio of the vertical length to the transverse width of each of said vacuum panels is in the range of about 3 to 1 to about 5 to 1.

22. The container according to claim 21, wherein the ratio of the vertical length to the transverse width of each of said vacuum panels is approximately 4.15 to 1.

23. The container according to claim 19, wherein the ratio of the surface area of a label mounting portion of said sidewall to the total area of said vacuum panels is approximately 1.75 to 1.

24. The container according to claim 19, wherein said outwardly projecting panel portions extend between said upper and lower edges of said vacuum panel and are oriented vertically within said vacuum panel, and wherein the ratio of the vertical length of said vacuum panel to the vertical length of one of said panel portions is in the range of about 2.5 to 1 to about 3 to 1.

25. A vacuum panel for a plastic container comprising: a vertically elongated back surface having a top and a bottom; a vertically elongated outwardly projecting upper panel portion spaced from said top; a vertically elongated outwardly projecting lower panel portion spaced from said bottom and from said upper panel portion; and first and second outwardly projecting connecting portions, said first connecting portion extending from said top to said upper panel portion and connecting said upper panel portion to said top, and said second connecting portion extending from said bottom to the lower panel portions and connecting said lower panel portion to said bottom.

26. The container vacuum panel according to claim 25, wherein said connecting portions reverse the curvature of said vacuum panel in the region between said upper and lower panel portions and said top and bottom of said vacuum panel.

27. The container vacuum panel according to claim 26, wherein the transverse width of each of said connecting portions increases in a direction from the edges of said upper and lower panel portions to said top and bottom of said vacuum panel.

28. The container vacuum panel according to claim 27, wherein said upper and lower panel portions are generally rectangular in shape, and wherein the transverse width of said connecting portions in the proximity of said top and bottom of said vacuum panel corresponds to the transverse width of said upper and lower panel portions.

29. The container vacuum panel according to claim 26, wherein said vacuum panel has first and second parallel vertical sides connected to said top and bottom of said vacuum panel by arcuately shaped corners having a radius of curvature in the range of about 10 to 12 mm.

* * * * *